United States Patent [19]

Martner

[11] 3,986,669

[45] Oct. 19, 1976

[54] ULTRASONIC TUBULAR EMULSIFIER AND ATOMIZER APPARATUS AND METHOD

[76] Inventor: John G. Martner, 49 James Ave., Atherton, Calif. 94025

[22] Filed: Mar. 23, 1976

[21] Appl. No.: 660,262

[52] U.S. Cl. ..... 239/102; 310/8.1; 310/8.2

[51] Int. Cl.[2] ..... B05B 17/06

[58] Field of Search ..... 239/102; 116/137 A; 261/DIG. 48; 310/8.1, 8.2, 8.7

[56] References Cited

UNITED STATES PATENTS

| | | | |
|---|---|---|---|
| 3,147,146 | 9/1964 | Sedlacsik, Jr. | 239/102 X |
| 3,214,101 | 10/1965 | Perron | 239/102 |
| 3,663,841 | 5/1972 | Parker | 310/8.2 |
| 3,804,329 | 4/1974 | Martner | 239/102 X |

*Primary Examiner*—John J. Love
*Attorney, Agent, or Firm*—Flehr, Hohbach, Test, Albritton & Herbert

[57] ABSTRACT

A tubular section is constructed for radial and axial resonance. The tubular resonator is clamped along a line of clamping engagement near one end of the tubular section and is driven by means of radially directed oscillatory force applied at a line of driving engagement spaced from the line of clamping engagement. The oscillatory force is obtained from a driver which is formed of an annulus of piezoelectric crystal polarized in a radial direction, having an inner base ring and outer annular driver wedge, triangular in cross section. Since the frequency of radial resonance is a function of the radius of the tubular section, and the frequency of axial resonance is a function of the length of the tubular section, the two frequencies of resonance are made to coincide by proper selection of tube radius and length and the resonant frequencies therefore made to reinforce one another. The clamp in one embodiment contains a manifold for receiving a liquid and has a plurality of conduits leading therefrom to an eflux position proximate to the surface of the tubular resonator.

The method of atomizing a liquid includes the steps of forcing a node near one end of the tubular resonator and driving the resonator tube into radial and axial resonance. Thereafter the process includes impinging the liquid on the surface of the resonator tube to form a liquid film thereon and perturbating the film with the vibratory motion of the surface until the liquid separates into droplets and is thrown from the resonating surface in atomized form.

24 Claims, 8 Drawing Figures

ULTRASONIC TUBULAR EMULSIFIER AND ATOMIZER APPARATUS AND METHOD

BACKGROUND OF THE INVENTION

This invention relates to an ultrasonic generator driven to assume a reinforced radial resonant mode and more particularly to such an ultrasonic generator for use in controlled atomization of liquids.

The manner in which structural members of various configurations assume modes of flexural vibration resonance is treated in some detail in U.S. Pat. No. 3,804,329 issued to the applicant herein. As disclosed therein lack of investigative apparatus and analytical techniques has been severely limiting in the design of vibrating systems which are capable of reaching sufficiently large magnitudes of resonance at sufficiently high frequencies over sufficiently large areas to provide for atomization of liquids at useful flow rates. Therefore atomization of liquids such as fuels for subsequent combustion, while consuming acceptably smaller power levels in obtaining the resonant modes in the vibratory atomizer has posed severe technical problems. Moreover, there has been a need to devise resonant vibrating structure which conform to the convenient shapes for use in devices such as carburetors, burners, and so forth which are used to process fuels prior to ignition so that efficient burning and reduction of pollutants is promoted. In the '329 patent, at column 14, relation D, the term $h$ is present. This is the thickness of the disc discussed. In column 13, lines 19 through 25, it is stated that the equations ($a$) to ($m$) therein are general, and that they may be more conveniently expressed in other than polar coordinates for plate or tubular resonators. In the relationships 14 and 15 recited hereafter in this disclosure, the cylindrical radius is the only tube dimension present in the expression for the radial resonant frequency and the cylinder length is the only tube dimension present in the expression for the axial resonant frequency expression. Thus, the distinction between the two approaches for obtaining resonant atomizing members is apparent.

It is apparent that an efficient, conveniently shaped high resonant amplitude resonator with predicitable resonating characteristics is needed for use in liquid atomization and emulsion formation applications.

SUMMARY AND OBJECTS OF THE INVENTION

An apparatus is provided which utilizes a tubular section with an inner and outer surface driven into an ultrasonic vibration mode. A force transducer for producing oscillatory radial force is mounted within the tubular section for transmitting the radial force to a line of contact on the inner surface of the tubular section. The radial force transducer is actuated by electrical energy. A clamp engages the outer surface of the tubular section proximate to one end thereof along a line of clamping engagement therearound. The line of force contact is spaced from the line of clamping engagement so that a node is forced at the line of clamping engagement when the tubular section is driven into the predetermined resonant mode by the oscillatory radial force transducer. The diameter and length of the tubular section are constructed to produce a radial and a longitudinal resonant vibration mode simultaneously therein so that the inner and outer surfaces of the tubular section are displaced in accordance with the radial and longitudinal resonant vibration modes which serve to reinforce one another.

A method for efficiently atomizing a liquid includes the steps of forcing a radial vibration node near one end of a resonator tube and driving the resonator tube into a radial resonance by applying a radial oscillatory driving force to the resonator tube. Thereafter, the liquid to be atomized is impinged on the surface of the resonating tube and the internal surface tension of the liquid is broken by the forces applied thereto due to the resonator tube surface motion, and the liquid is thrown from the resonator tube surface in atomized form.

In general it is an object of the present invention to provide an ultrasonic tubular resonator for efficient atomization and emulsification of liquids.

Another object of the present invention is to provide a tubular resonator having a convenient outline shape for use with familiar fuel combustion devices.

Another object of the present invention is to provide a tubular resonator which is capable of producing an emulsion of two or more liquids.

Another object of the present invention is to provide a tubular resonator for producing a high atomization rate of liquids at ultrasonic frequencies.

Another object of the present invention is to provide a tubular resonator for use in combustion systems for reducing pollutants by increasing the system combustion efficiency.

Additional objects and features of the present invention will appear from the following description in which the preferred embodiments have been set forth in detail in conjunction with the accompanying drawings.

DESCRIPTION OF THE PREFERRED EMBODIMENTS

Figure 1:
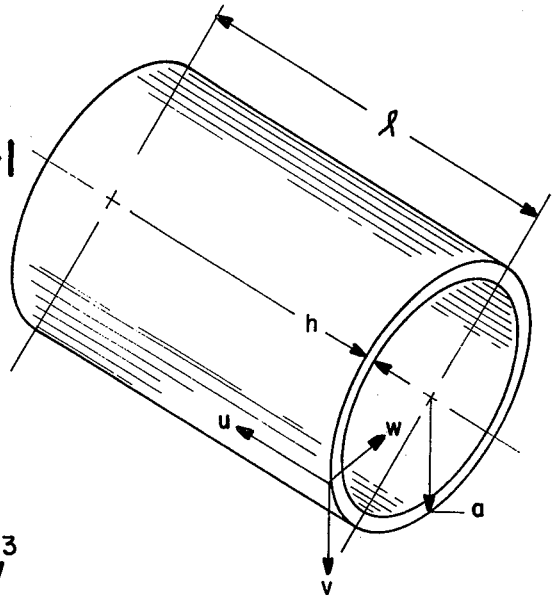
FIG. 1 is a model of a tubular section for explaining theoretical vibration phenomena.

Referring to FIG. 1 one type of resonator tube 11 is shown. Tube 11 is shown as a section of constant diameter tubing. It should be understood that the resonator tube 11 may take any one of a number of shapes; i.e. it may be flared at one end or take the form of a thin shell of a frustum of a cone. The resonator tube 11 of FIG. 1 has a radius $a$, , wall thickness $h$, and axial length $l$. The ensuing analysis of the vibration characteristics of the resonator tube section 11 utilizes $u$, $v$, and $w$ which represent the longitudinal, tangential and radial displacements respectively of a particle of the tube section.

The following general equations for providing a description of the vibration of cylinders considered as thin tubes were derived by A. E. H. Love in his "Treatise on the Mathematical Theory of Elasticity," Dover, N.Y., published in 1944. The symbols in Love's equations are defined as follows:

U, V, W: Coefficients defining the shape of the vibrational modes.

$\sigma$ : Poisson's Ratio $l$ : length of the cylinder, centimeters $a$ : radius of the cylinder, centimeters $h$ : thickness of the cylinder, centimeters $n$ : number of circumferential waves in the mode of vibration $f$ : frequency in Hertz units $\rho$ : density of the material, grams per cubic centimeter E : Young's modulus, dynes per square centimeter $f_1$ : circular frequency, $2\pi f$ D : flexural ridigity, $h^3E/\rho\ (1\text{-}\sigma^2)$ Since $h$ does not appear in the equations or in the boundary conditions, the frequencies are independent of the thickness of the cylinder wall $h$. Due to the fact that a driving transducer must exert force omnidirectionally in a fashion so that no part of the driving transducer is ever in tension, the resonator tube section 11 must vibrate in a symmetrical pattern. Ceramic driving transducers are weak in tension and easily fractured. The design parameters must account for this practical driving transducer consideration. Consequently, for the case of symmetrical vibration the relationships 5 hold.

$$u=U\cos(f_1t+\epsilon);\ v=V\cos(f_1t+\epsilon);\ w=W\cos(f_1t+\epsilon) \tag{5}$$

From relations 4 and 5 above, one obtains the following:

$$\frac{3D}{h^3}\left[\frac{d}{dx}\left(\frac{dU}{dx}-\sigma\frac{W+nV}{a}\right)-\frac{1-\sigma}{2}\frac{n}{a}\left(\frac{dV}{dx}+\frac{nU}{a}\right)\right]+2\rho f_1^2U+\frac{D}{h}\left[\frac{2-2\sigma-3\sigma^2}{2(1-\sigma)a}\frac{d^3W}{dx^3}+\frac{1+2\rho^2}{2(1-\sigma)}\frac{n}{a^3}\frac{d}{dx}(V+nW)\right]=0 \tag{1}$$

$$\frac{3D}{h^3}\left[\frac{n}{a}\left(\sigma\frac{dU}{dx}-\frac{W+nV}{a}\right)+\frac{1}{2}(1-\sigma)\frac{d}{dx}\left(\frac{dV}{dx}+\frac{nU}{a}\right)\right]2\rho f_1^2V+\frac{D}{h}\left[-\frac{\sigma+2\sigma^2}{2(1-\sigma)}\frac{n}{a^2}\frac{d^2W}{dx^2}+\frac{2+\sigma}{2(1-\sigma)}\frac{n^2}{a^4}(V+nW)+\frac{1}{2}\frac{1-\sigma}{a^2}\frac{d^2}{dx^2}(V+nW)+\frac{n}{a^2}\frac{d^2W}{dx^2}-\frac{n^3}{a^4}W+\frac{1-\sigma}{a^2}\frac{d^2V}{dx^2}-\frac{n^2}{a^4}V\right]=0 \tag{2}$$

$$\frac{3D}{h^3}\left[\frac{\sigma}{a}\frac{dU}{dx}-\frac{W+nV}{a^2}\right]+2\rho f_1^2W-\frac{D}{h}\left[\frac{d^4W}{dx^4}-\frac{2n^2}{a^2}\frac{d^2W}{dx^2}+\frac{n^4}{a^4}W-(2-\sigma)\frac{n}{a^2}\frac{d^2V}{dx^2}+\frac{n^3}{a^4}v+\frac{\sigma+2\sigma^2}{2(1-\sigma)a^2}\frac{d^2W}{dx^2}-\frac{2+\sigma}{2(1-\sigma)}\frac{n}{a^4}(nV+W)\right]=0 \tag{3}$$

Above equations 1, 2 and 3, may be solved by making the proper assumptions as to the mode of vibration desired and introducing the proper boundary conditions. In doing this two kinds of vibrations are found to be possible for this kind of cylindrical resonator. These kinds of vibrations are termed extensional or inextensional, depending on whether the central layer of the cylindrical or thin-walled shell undergoes extension or not. In the design of the ultrasonic resonators considered herein the generation of extensional modes only was considered since these modes are relatively simple and circumferentially symmetrical. Thus, the extensional modes form complete rings around the cylinder which are readly propogated by the type of drive transducer used herein. Extension of the central layer is accompanied by bending or flexing which is what is desirable in the resonator to attain the high resonant amplitudes desired. Equations 1, 2 and 3 above contain terms in (a) which is the radius of the tubular section 11. These terms are in the denominators signifying that the smaller the radius of the tubular section 11, the higher will be the resonant frequency of the tubular resonators. High vibration frequencies disperse liquids deposited on the surfaces of the vibrating members in aerosols having smaller component droplets.

The equations for extensional vibrations are obtained from relationships 1, 2 and 3 above by omitting the terms having the coefficient $D/h$. The determinantal equation for $m^2$ at $x=\pm l$ become $T_1=0$ and $S_1=0$.

$$\frac{dU}{dx}-\sigma\frac{W+nV}{a}=0;\quad \frac{dV}{dx}+\frac{nU}{a}=0 \tag{4}$$

$$\frac{E}{1-\sigma^2}\left(\frac{d^2U}{dx^2}+\frac{\sigma}{a}\frac{dW}{dx}\right)+\rho f_1^2U=0 \tag{6}$$

$$\frac{E}{2(1+\sigma)}\frac{d^2V}{dx^2}+\rho f^2V=0 \tag{7}$$

$$\frac{E}{1-\sigma^2}\left(\frac{\sigma}{a}\frac{dU}{dx}-\frac{1}{a^2}W\right)+\sigma f_1^2W=0 \tag{8}$$

The boundary conditions at $x=\pm l$ are:

$$\frac{dU}{dx}-\sigma\frac{W}{a}=0;\quad \frac{dV}{dx}=0 \tag{9}$$

Thus, two classes of symmetrical vibrations are obtained. One relates to torsional vibrations of the cylindrical resonator which are useless for the purposes described here. The other class of vibrations, where V vanishes provides vibration, the displacement which occurs in planes perpendicular to the axis of the resonator tube 11. The following equations thus are obtained:

$$U=\xi\cos\frac{n\pi x}{l};\ W=\zeta\sin\frac{n\pi x}{l} \tag{10}$$

The above equation 10 the quantities $\delta$ and $\zeta$ are related by the equations:

$$\left[f_1^2-\frac{E}{\rho(1-\sigma^2)}\frac{n^2\pi^2}{l^2}\right]\xi-\frac{E\sigma}{\rho(1-\sigma^2)}\frac{n\pi}{la}\zeta=0 \tag{11}$$

$$\left[f_1^2-\frac{E}{\rho(1-\sigma^2)}\frac{1}{a^2}\right]\zeta-\frac{E\sigma}{\rho(1-\sigma^2)}\frac{n\pi}{la}\xi=0 \tag{12}$$

The above relationships 11 and 12 provide the general equation for the resonant frequency $f_1$ which follows:

$$f_1^4 - f_1^2 \frac{E}{\rho(1-\sigma^2)}\left(\frac{1}{a^2} + \frac{n^2\pi^2}{l^2}\right) + \frac{E^2 n^2 \pi^2}{\rho^2(1-\sigma^2)^2 a^2 l^2} = 0 \qquad (13)$$

In the design of the atomizer utilizing resonant tube section 11 it is desirable to have a cylinder length 1 which is large relative to the cylinder radius $a$. This provides a small $a/l$ ratio. By solving equation 13 there appear two solutions. If the following relationships are allowed:

$$\frac{E}{\rho(1-\sigma^2)} = c^2$$

$$K = \frac{n^2\pi^2}{l^2}$$

$$f = \frac{f_1}{2\pi}$$

then the two solutions become:

$$f_1^2 = \frac{c^2}{2}\left(\frac{1}{a^2} + K\right) \pm \frac{c^2}{2}\left(\frac{1}{a^2} - K\right)$$

Substituting the relations for $c^2$, $K$ and $f$, an equation descriptive of a substantially radial mode is obtained:

$$f_R = \frac{1}{2\pi a}\left[\frac{E}{\rho(1-\sigma^2)}\right]^{1/2} \qquad (14)$$

In like manner the relation for a substantially axial mode is obtained:

$$f_L = \frac{nc}{2l} = \frac{n}{2l}\sqrt{\frac{E}{\rho}} \qquad (15)$$

Equation 15 is obtained utilizing the rod velocity equation $$c = \sqrt{\frac{E}{\rho}}.$$

The optimum design of the resonator tube section 11 requires that the two vibration frequencies, radial and axial, described above by equations 14 and 15, occur at substantially the same frequency. The resulting vibratory motion will provide optimum atomization of a liquid impinging on the vibrating surface. Thus, $f_R = f_L$. Using the value for $\sigma$ in aluminum of 0.33, the following equations result:

$$\therefore \frac{a}{l} = \frac{1}{n\pi\sqrt{1-\sigma^2}} \quad \therefore \frac{a}{l} = .3372n \qquad (16)$$

To confirm the vibratory motions described by equations 14 and 15 above, and to determine whether the motions are suitably large enough in amplitude to produce efficient atomization of a liquid impinging on a surface experiencing vibratory motion in accordance therewith, a cylinder was designed, fabricated and driven by application of oscillatory radial force. The dimensions of the resonator tube section 11 were chosen so that the radial and axial frequencies obtained were slightly different, but relatively close to the oscillatory driving frequency. The oscillatory driving frequency was selected as 50.5 kilohertz, the length of the resonating tube 11 was 4.65 cm and the radius of the resonating tube 11 was 1.78 cm. Aluminum was used as the tube material. Young's Modulus for the aluminum material was $6.98 \times 10^{11}$ dynes per square centimeter. Density was 2.7 grams per cubic centimeter. $\sigma$ was 0.33. Using equation 14 above the radial frequency computes as 48.37 kilohertz. Using equation 15 above the axial frequency computes as 54.30 kilohertz, assuming $n = 1$. The thickness of the resonator tube section 11 was selected as 0.05 inches.

Measured frequencies of resonance for the above described resonator tube section were $f_R = 49$ kilohertz and $f_L = 53.88$ kilohertz. It was found that the resulting vibration amplitude at the vibratory surfaces of resonator tube section 11 were large enough to produce atomization of water fed on any external or internal cylindrical surface of resonator tube 11. Atomization was more efficiently obtained when the resonator tube 11 was driven at the frequency of radial resonance $f_R$, than when driven at the frequency of axial resonance $f_L$. Driving resonator tube section 11 at the latter resonant frequency generated more heat within the resonator tube body, which signifies loss of energy to heat energy and reduced efficiency of atomization. This reduced efficiency is considered to be due to mismatch between vibratory motion in the radial and axial modes excited in the resonator tube 11.

A second feasibility experiment was undertaken introducing the condition imposed by equation 16. For $n = 1$ the relationship $a/l = 0.3372$ was maintained. Resonator tube section 11 was fabricated having a radius $a = 0.70$ inches and length $l = 2.07$ inches. The material was aluminum having the physical characteristics given above for the first described cylinder. The following calculated values were obtained using the conditions imposed by relationship (16) $f_R = 48.372$ kilohertz; $f_L = 48.55$ kilohertz. After fabrication of the resonator tube section 11 to the above specifications, measured radial and axial frequencies were obtained as follows: $f_R = 49.02$ kilohertz; $f_L = 49.15$ kilohertz.

The second fabricated resonator tube section 11 was driven by application of oscillatory radial force thereto and tested for atomization capability. The second fabricated resonator tube was found to be considerably more efficient in atomizing water directed to impinge on the surfaces thereof. All of the water directed to the surfaces of the resonator tube section 11 was instantly atomized and there appeared no loading effect on the resonator tube to reduce atomization at feed rates of liquid to the resonator surfaces up to 3800 cubic centimeters per minute. There was no heating of the resonator, indicating a high degree of obtained efficiency for atomization.

Figure 2:
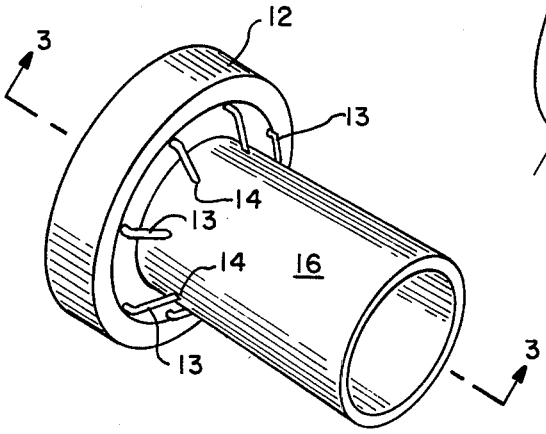
FIG. 2 is an isometric view of the emulsifier and atomizer apparatus.

Turning now to FIG. 2, a description of the structure of the disclosed ultrasonic generator will be undertaken. Resonator tube section 11 is preferably made of a metal or ceramic material. A clamp 12 surrounds one end of resonator tube section 11. A plurality of conduits 13 extend from the body of clamp 12 to an efflux position 14 overlying the exterior surface 16 of resonator tube section 11.

Figure 3:
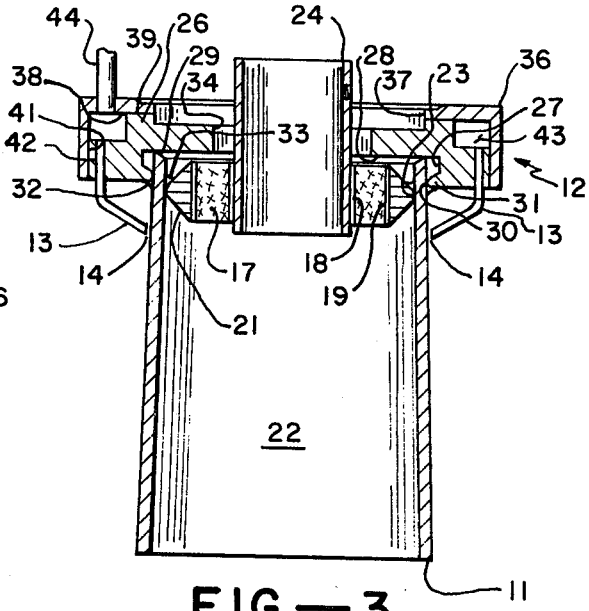
FIG. 3 is a sectional view along the line 3—3 of FIG. 2.

Turning now to the internal construction of the ultrasonic generator, attention is directed to FIG. 3 of the drawings. A driving piezoelectric element 17 is formed in an annular configuration and polarized radially having electrodes 18 and 19 at inner and outer diameters thereof respectively. A metallic driver ring 21 having a triangular cross section is bonded to the outer diameter of the driving transducer. The metallic ring 21 functions to protect the driving transducer material from fracture and to apply the driving force generated by the driving transducer 17 onto a driver line 23 or narrow region around an inner surface 22 on the resonator tube section 11. A backing ring 24 is bonded to the inside diameter of driver transducer 17 serving as a support for the radial force provided by the driver transducer 17. The backing function is obtained due to the relative stiffness of the backing ring 24 inherent in the smaller mean diameter of the ring relative to the inside diameter of the resonator tube section 11. Backing ring 24 could conceivably be a solid cylindrical section depending on the application in which the ultrasonic resonator is utilized.

Clamp 12 is shown in FIG. 3 having a main clamp body 26 surrounding one end of resonator tube section 11. Main clamp body has an internal bore 27 on one face thereof which is disposed toward resonator tube section 11 in the assembly, and a planar surface 28 at the bottom of internal bore 27. A chamber 29 is formed at the end of resonator tube section 11 which is surrounded by main clamp body 26, so that minimal contact between the end of resonator tube section 11 and surface 28 on main clamp body 26 is obtained. A land 31 is formed on internal bore 27 extending inwardly for contacting the outer surface 16 of resonator tube section 11 at a clamping line 30 therearound which is displaced axially from driver line 23. Land 31 is bonded to outer surface 16 by means of a cement fillet 32 placed therebetween. Driver ring 21 is bonded to the inner surface 22 by means of a cement fillet 33 therebetween. A hole 34 extends through main clamp body 26 for allowing backing ring 24 to pass therethrough in this embodiment.

Clamp 12 may be configured to incorporate a liquid feeding system for delivering a liquid to the outer surface 16 of resonator tube section 11. As seen in FIG. 3, a cover 36 is provided which is cup shaped in configuration having a hole 37 therethrough for allowing passage of backing ring 24 and having a bottom 38 for sealed contact with a face 39 on main clamp body 26. Cover 36 also has an inside diameter 41 for sealed contact with an outside diameter 42 on main clamp body 26. The assembly of cover 36 and main clamp body 26 is seen to provide a sealed chamber 43 which has an annular configuration in this embodiment. Conduits 13 are in communication with annular chamber 43 at one end and are overlying outer surface 16 on resonator tube section 11 proximate thereto at efflux position 14 on the other end. Tube 44 is provided in communication with annular chamber 43 for introducing a liquid thereto.

Figure 4:
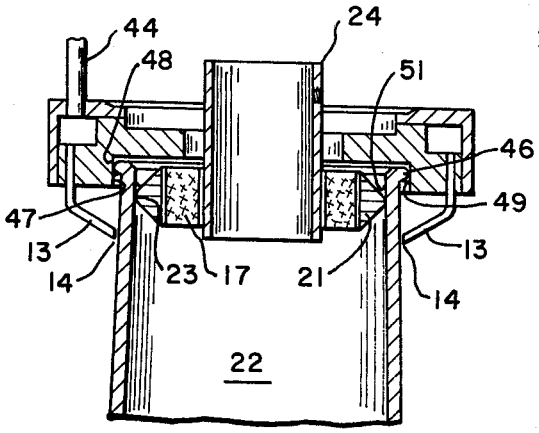
FIG. 4 is a sectional view of another embodiment of the invention along the line 3—3 of FIG. 2.

The embodiment of FIG. 4 is identical to the embodiment of FIG. 3 except for the manner in which clamp 12 engages the outer surface 16 of resonator tube section 11 along the aforementioned clamping line. Resonator tube section 11 has a land 46 extending outwardly therefrom at the end thereof surrounded by clamp 12. Main clamp body 26 has a cylindrical internal bore 47 which is contacted by land 46 on a clamping line 48 therearound. A fillet of adhesive 49 is provided for bonding land 46 to the surface of bore 47. A fillet of adhesive 51 is provided for bonding driver ring 21 at the inner surface 22 of resonator tube section 11. Driver line 23 is spaced axially from clamping line 48 in the embodiment of FIG. 4 with clamping line 48 closer to the end of resonator tube section 11 surrounded by clamp 12. A node is forced at clamping line 48 and vibratory modes are induced in resonator tube section 11 by the radial driving force produced by the radially polarized driver transducer 17 contacting the inner surface 22 at driver line 23 therearound. The advantage obtained in this configuration lies in the lessening of the possibility of relative axial movement between the clamping line 48 and the driver line 23 since both lines are determined by the structure on the same member, resonator tube section 11. Such axial movement would change the effect of the driving force on the resonator. Clamp 12 in the embodiment of FIG. 4 may assume the same configuration as that shown in FIG. 3 for delivering liquid to the outer surface 16 on resonator tube section 11.

Figure 5:
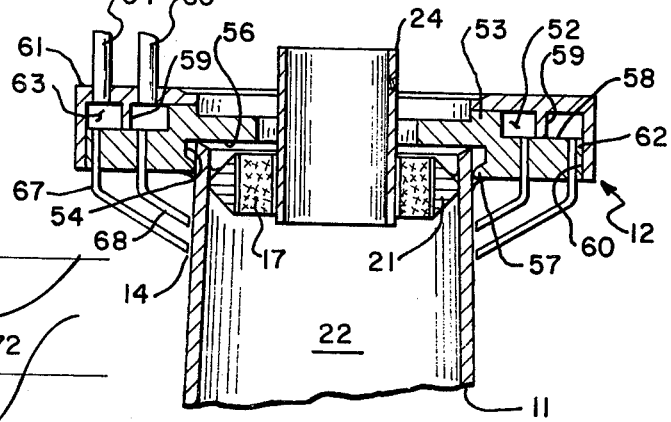
FIG. 5 is a sectional view of yet another embodiment along the line 3—3 of FIG. 2.

Turning now to FIG. 5, clamp 12 is shown having an additional annular chamber 52. Clamp 12 in this embodiment includes a main clamp body 53 having a centrally located internal bore 54 therein with a planar face 56 at the bottom thereof. Bore 54 has formed on the surface thereof a land 57 extending inwardly to contact the outer surface 16 of resonator tube section 11. Additional annular chamber 52 and an adjacent annular chamber 63 provides a pair of chambers which are separately formed by sealable contact between a face 58 on main clamp body 53 and a cylindrical flange 59 on a cover 61 formed to sealably fit around an outside diameter 62 on main clamp body 53. Cylindrical flange 59 serves to separate the annular chambers 52 and 63 as seen in FIG. 5. An inlet tube 64 is provided for introducing a first liquid into annular chamber 63 and another inlet tube 66 is provided for introducing a second liquid into annular chamber 52. A plurality of conduits 67 is provided each having one end in communication with annular chamber 63 and having the other end positioned overlying outer surface 16 of resonator tube section 11 in a position similar to efflux position 14 described above. A plurality of additional conduits 68 is provided each having one end in communication with annular chamber 52 and having the other end in a position overlying outer surface 16 of resonator tube section 11 at a position adjacent to efflux position 14 as seen in FIG. 5. The remainder of the items in FIG. 5 are similar to those recited in the embodiments of FIGS. 3 and 4 above and like item number are assigned thereto.

The manner in which the embodiments of FIGS. 3, 4 and 5 operate will now be described. Driver transducer 17 is radially polarized as described above and provides an oscillatory radial force due to elastic radial expansion and contraction when excited by an oscillatory electrical signal impressed between electrodes 18 and 19. When resonator tube section 11 is clamped at one end and driven at a predetermined radial frequency providing force pulses through driver ring 21 to the driver line 23 displaced from clamping line 30, a node is forced at clamping line 30. Dependent upon the radius of resonant tube section 11 and the length thereof, certain primary resonant frequencies or harmonics thereof are present in the resonator tube 11 depending upon the material from which it is fabricated. When the radial and axial resonant frequencies or harmonics, are caused to coincide by proper selection of the physical dimensions discussed above for the resonator tube section 11, and the resonator tube 11 is driven at a frequency which is close to the primary radial and axial resonant frequencies, resonant harmonic modes of vibration are induced in the resonator tube section 11 causing an ultrasonic vibratory mode at the surfaces thereof wherein the radial and axial vibratory modes reinforce one another.

Figure 6:
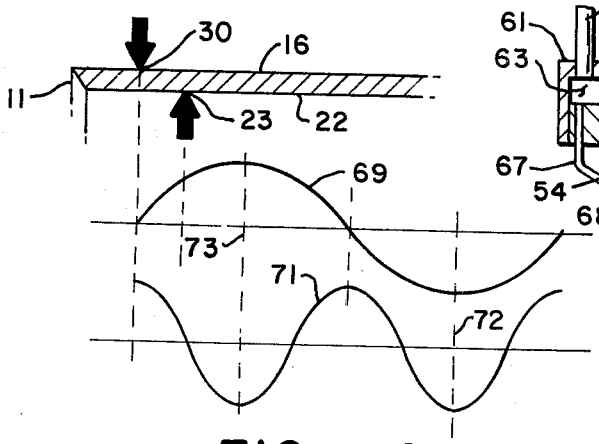
FIG. 6 is a mechanical schematic and chart showing the relation of radial and axial resonances.

The manner in which the resonant radial and axial frequencies reinforce one another and thereby provide an optimum resonant amplitude for efficient atomization of liquid impinging upon the resonating surfaces is shown in FIG. 6. Driver line 23 is seen displaced from clamping line 30 at which a node is forced in the radial resonant wave 69, which may be the primary resonant frequency or any harmonic thereof. Since the radial and axial resonant frequencies are predetermined by structural design of the resonator tube section 11 to be similar as described above, an axial harmonic 71 of the axial resonant frequency $f_L$ is excited which reinforces the radial vibratory mode 69 as seen at the dashed line 72 in FIG. 6. Since the radial vibration 69 shortens the length of resonator tube section 11 each time wave 69 reaches a maximum or a minimum, there will be alternate areas of reduced vibration amplitude, as seen at dashed line 73 and increased vibration amplitude as seen at dashed line 72. Lateral spreading or contraction reaches a maximum or a minimum. Thus, amplitude amplification is provided not only by resonance, but by reinforcement between the radial and axial resonant frequency or harmonics thereof.

A liquid introduced through the tube 44 in either the embodiment of FIG. 3 or FIG. 4 is thereby delivered to the vibratory outer surface 16 of resonant tube section 11 through conduits 13 to impinge thereon and be thrown therefrom in atomized form as the internal surface tension of the liquid is overcome. FIG. 5 on the other hand provides an embodiment in which more than one liquid may be deposited at closely spaced points overlying the outer surface 16 of resonator tube section 11, the liquids mixing together and thereafter being atomized by the vibratory action of surface 16. Consequently the combined liquids will form an emulsion which is atomized. The atomized emulsion consists of an inner droplet of one of the two liquids surrounded by an outer sheath of the other of the two liquids. This presumes that the two liquids are immiscible.

Figure 7:
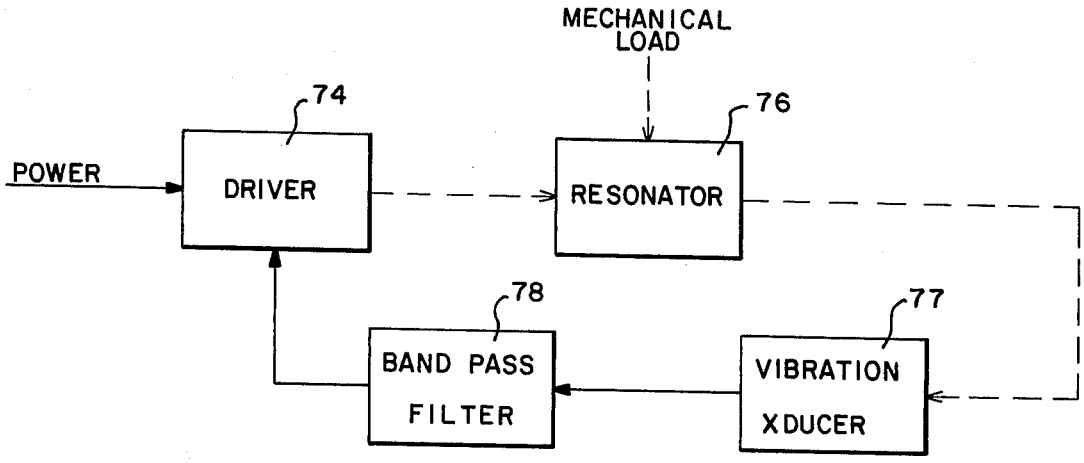
FIG. 7 is a block diagram of the emulsifier and atomizer apparatus in a closed control loop.

Turning now to FIG. 7 of the drawings an embodiment of the tubular emulsifier and atomizer is shown in block form including a driver 74 for receiving power from an electrical energy source. The driver 74 is mechanically coupled to a resonator 76 which also may have coupled thereto a mechanical load as shown. A vibration transducer 77 is positioned so as to sense the vibration of resonator 76 and produces an output signal which is indicative of the vibratory characteristics of resonator 76. The vibration output signal from vibration transducer 77 is connected to a band pass filter 78, which has a band width which includes the practical frequencies of resonance of resonator 76 considering the practical mechanical loadings applied thereto. Band pass filter 78 passes the vibration output signal to driver 74 to modify the driving frequency provided therefrom, so that it assumes a predetermined driving frequency for providing radial displacement to resonator 76 which maintains a resonant radial vibration mode therein in the presence of the partical mechanical loading applied.

Figure 8:
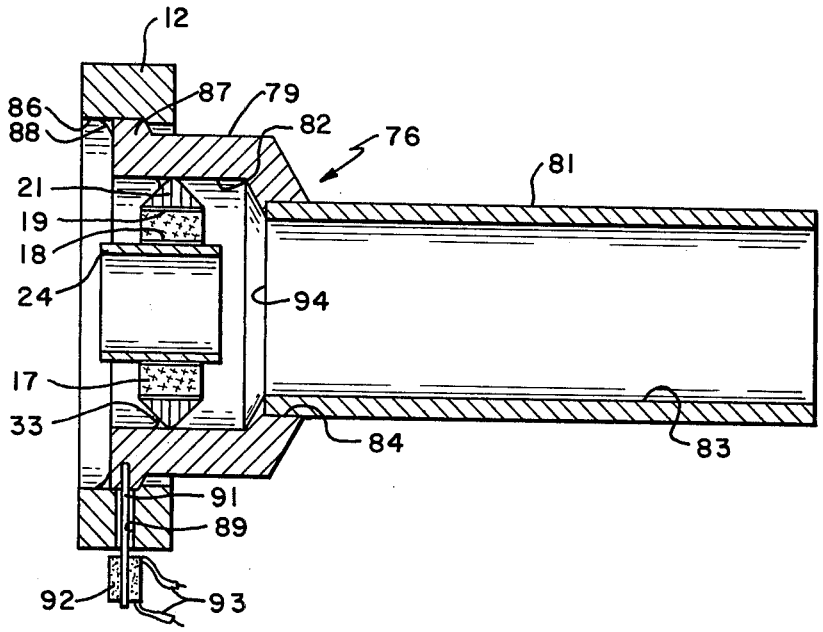
FIG. 8 is a sectional view of an additional embodiment of the invention.

Turning now to FIG. 8, driver 74 is seen to include driver transducer 17 having inner and outer electrodes 18 and 19 respectively thereon for excitation by the predetermined driver frequency. Driver ring 21 is positioned on the outer periphery of driver transducer 17 and backing ring 24 is positioned on the inner diameter of driver transducer 17 in the same manner as described for the embodiment of FIGS. 3 through 5 above.

The embodiment of FIG. 8 shows resonator 76 as a compound resonator having a driving section 79 and a resonant section 81. Driving section 79 has a larger inside diameter 82 which is contacted by driver ring 21 on a line of driving contact therearound. Resonator section 81 has a smaller inside diameter which therefore provides for higher frequency of radial resonance as described hereinbefore. Driving section 79 is terminated at one end to form a bore 84 therein, for tightly fitting around the outside diameter of resonant section 81. Driving section 79 may be fabricated of aluminum material and heated to receive resonant section 81 in bore 84. Resonant section 81 may be fabricated of steel material having an outside diameter such that when the driving and resonator sections stabilize in temperature resonator section 81 is tightly held in bore 84. Alternately resonator section 81 may be press fit into bore 84.

Driver transducer 17, driver ring 21 and backing ring 24 are but a portion of the driver 74 shown in FIG. 7. Driver 74 includes electronic circuitry for receiving the power from an electrical energy source and providing a driving signal at a predetermined driving frequency. Driver ring 21 is held firmly against the inside diameter 82 along the line of driving contact by a cement fillet 33 as described above. Clamp 12 has also been previously described having an internal bore 86 in this embodiment. Driving section 78 has a land 87 formed therearound for contacting the surface of internal bore 86 along a clamping line therearound. A cement fillet 88 is formed between internal bore 86 and the end of driving section 79 on which land 87 is formed. A hole 89 is formed in a radially direction through clamp 12 passing through the surface of internal bore 86. A rod 91 is fixed in driving section 79 extending in a radial direction therefrom through hole 89. A vibration transducer 92 is mounted on rod 91 for monitoring the vibration characteristics of resonator 76 and for producing a vibration output signal indicative thereof. Vibration output signal is presented in electrical conductors 93 for connection as desired. When used in the embodiment of FIG. 7, the vibration output signal is connected through conductors 93 to band pass filter 78 as described above for controlling the predetermined driving frequency applied to the line of contact spaced from the end of resonator 76 upon which land 87 is formed. Driving section 79 is firmly connected to resonant section 81 at a common end 94 therebetween. A first distance therefore exists axially between the clamping line between land 87 and internal bore 86 and common end 94 and a second distance exists between the clamping line and the line of contact between driver ring 21 and inside diameter 82 of driving section 79. It may be seen that there is a driving force amplification which occurs in accordance with the ratio of the above described first two second distances. Therefore, greater amplitudes of radial and axial vibration are imparted to resonant section 81. Since the diameter of resonant section 81 may be made smaller through this configuration, without reducing the size of driver transducer 17, the resonant frequency may therefore be made higher than the resonant frequencies of the foregoing embodiments. These greater amplitude and higher resonant frequency characteristics provide atomized droplets of smaller diameters and also higher volumetric rates of atomization. For example, a resonator section 81 has been fabricated having a diameter of 0.95 inches made of steel material which provided a resonant frequency of 71.365 kilohertz. Amplitude of vibration was improved by a factor of 31% compared to those embodiments of FIGS. 3 through 5. Atomization rate achieved was in access of 5 liters per minute of water. The embodiment of FIGS. 7 and 8 may clearly be utilized for producing atomized emulsions of two or more liquids in the manner described above for the embodiment of FIG. 5.

Apparatus has been disclosed for providing an ultrasonically vibrating surface for atomization of a liquid or for emulsification of two or more liquids, efficiently and at a high rate of liquid feed.

What is claimed is:

1. Apparatus for providing an ultrasonically vibrating surface, comprising a tubular section having an inner surface and an outer surface and first and second open ends, a radial force transducer mounted within said tubular section transmitting radial force to a line of contact on said inner surface spaced from said first end, said radial force transducer being actuated by electrical energy, and a clamp engaging said outer surface proximate to said first end so that when an alternating electrical signal having an ultrasonic frequency is connected to said force transducer, said clamp forces a node in said tubular section where it engages said outer surface and said tubular section is driven in a radial vibration mode and a longitudinal vibration mode simultaneously, whereby said inner and outer surfaces are displaced radially at areas therealong at a vibration frequency related to said ultrasonic frequency.

2. Apparatus as in claim 1 wherein said tubular section has a predetermined radius and a predetermined length, said predetermined radius providing a predetermined resonant radial frequency and said predetermined length providing a predetermined resonant longitudinal frequency, said predetermined radial and longitudinal frequencies being sufficiently in proportion to reinforce one another, whereby greater radial displacement is obtained at said inner and outer surfaces.

3. Apparatus as in claim 1 wherein said radial force transducer comprises an annular piezoelectric element having radial polarization, an inner support member mounted against the inner diameter of said annular piezoelectric element, an annular driving member mounted on the outer diameter of said annular piezoelectric element, and a narrow land on the periphery of said annular drive member for engaging said line of contact.

4. Apparatus as in claim 1 wherein said clamp includes an inwardly extending land for engaging said outer surface.

5. Apparatus as in claim 1 wherein said clamp has an inner clamp surface surrounding said first end, said outer surface including an outwardly extending land proximate to said first end providing a line of engagement on said outer surface contacting said inner clamp surface, whereby axial spacing between said line of contact and said line of engagement is maintained for axial clamp movement and said radial and longitudinal vibration modes retain predetermined resonant amplitudes.

6. Apparatus as in claim 1 wherein said clamp comprises a clamp body, means formed on said clamp body surrounding said first end and contacting said outer surface at a line of engagement therearound, said clamp body having a chamber formed therein for receiving a liquid, and a conduit extending from said chamber to an efflux position proximate to said outer surface, whereby liquid received in said chamber is delivered to said outer surface for atomization as it impinges on said outer surface at said areas of radial displacement.

7. Apparatus as in claim 6 together with an additional chamber formed in said clamp body for receiving an additional liquid, and an additional conduit extending from said additional chamber to a position adjacent to said efflux position, whereby the additional liquid received in said additional chamber is delivered to said outer surface and an emulsion of the liquid and additional liquid is formed as additional liquid impinges on said outer surface at said areas of radial displacement.

8. Apparatus as in claim 6 wherein said chamber is an annular manifold, together with a plurality of additional conduits extending from said annular manifold to additional efflux positions proximate to said outer surface.

9. Apparatus as in claim 1 wherein said tubular section comprises first and second sections joined at one common end, said inner surface including a larger inside diameter within said first section and a smaller inside diameter within said second section, said line of contact being on said larger inside diameter, said outer surface including a larger outside diameter on said first section and a smaller outside diameter on said second section, said clamp engaging said larger outside diameter on a clamping line therearound, whereby the amplitude of radial displacement at said one common end is amplified by the ratio of a first distance from said clamping line to said one common end to a second distance from said clamping line to said line of contact.

10. Apparatus as in claim 9 wherein said second section has a resonant radial vibration mode together with a vibration sensor for detecting the vibration mode of said tubular section and providing an output signal indicative thereof, and a driver coupled to said output signal for providing said alternating electrical signal, whereby said ultrasonic frequency is modified by said output signal to provide a modified resonant radial vibration mode in the presence of mechanical loading on said second section.

11. An ultrasonic vibration generator energized by an electrical energy source providing a driving signal at a predetermined driving frequency, comprising a resonator tube having inner and outer wall surfaces and first and second ends, a clamp surrounding said first end contacting said outer wall surface on a line of clamp engagement therearound proximate to said first end, a radial transducer coupled to the electrical energy source converting said driving signal to a radial displacement at the predetermined driving frequency, and means for transmitting said radial displacement to said inner surface on a line of driver contact therearound, said line of driver contact being displaced axially from said line of clamp engagement, said resonator tube having a predetermined radius providing a resonant radial vibration mode excited by the predetermined driver frequency, whereby radial displacement of said inner and outer surfaces is amplified.

12. An ultrasonic vibration generator as in claim 11 wherein said resonator tube has a predetermined length providing a resonant axial vibration mode excited by the predetermined driver frequency, thereby reinforcing said resonant radial vibration mode.

13. An ultrasonic vibration generator as in claim 11 wherein said clamp has an inwardly extending land for engaging said outer surface.

14. An ultrasonic vibration generator as in claim 11 wherein said clamp has an inner clamp surface, said outer surface including an outwardly extending land therearound in contact with said inner clamp surface, whereby said lines of clamp engagement and drive engagement maintain axial spacing when said clamp moves axially.

15. An ultrasonic vibration generator as in claim 11 wherein said clamp comprises a clamp body and an annular chamber formed therein for receiving a liquid, a plurality of conduits extending between said annular chamber and separate efflux positions proximate to said outer surface, whereby liquid received in said chamber is delivered to said outer surface for atomization by the radial displacement of said outer surface.

16. An ultrasonic vibration generator as in claim 15 together with an additional annular chamber formed in said clamp body for receiving an additional liquid, and an additional plurality of conduits extending between said additional annular chamber and separate positions adjacent to ones of said separate efflux positions, whereby additional liquid received in said additional annular chamber is delivered to impinge on said outer surface and an emulsion of the liquid and additional liquid is formed spaced from said outer surface.

17. An ultrasonic vibration generator as in claim 11 wherein said resonator tube is a compound tube, a driving section and a resonant section in said compound tube; said driving section and resonant section being joined at one end thereof, said predetermined radius being smaller in said resonant section than in said driving section, said resonant radial vibration mode being an inverse function of said resonant section radius, whereby said resonant radial vibration mode in said resonant section is increased in frequency.

18. An ultrasonic vibration generator as in claim 11 wherein said resonant radial vibration mode is modified by mechanical loading of said resonator tube, together with a vibration transducer providing a vibration output signal related to radial vibration of said resonator tube, said vibration output signal being coupled to said electrical energy source for modifying said predetermined driving frequency to coincide with said modified resonant radial vibration mode, whereby resonance is maintained in said resonator tube when mechanical loading is applied thereto.

19. An ultrasonic generator comprising a tubular resonator section having inner and outer cylindrical surfaces and similar radial and longitudinal resonant frequencies, a driver having a peripheral driving land for applying an oscillatory radial force to said inner cylindrical surface on a driver line therearound, a clamp surrounding one end of said tubular resonator section, means disposed between said clamp and said tubular resonator section for engaging said outer cylindrical surface on a clamping line therearound, said last named means inducing a vibration node at said clamping line, said driver line being displaced therefrom, said oscillator radial force having a driver frequency similar to said radial and longitudinal resonant frequencies, whereby radial and longitudinal frequencies exicted in said tubular resonator section reinforce one another and vibratory motion having increased amplitude is created on said inner and outer cylindrical surfaces.

20. An ultrasonic generator as in claim 19 wherein said means disposed between said clamp and said tubular resonator is an inwardly projecting land on said clamp.

21. An ultrasonic generator as in claim 19 wherein said means disposed between said clamp and said tubular resonator is an outwardly projecting land on said one end of said tubular resonator.

22. An ultrasonic generator as in claim 19 wherein said clamp has an annular chamber therein together with a plurality of conduits in communication with said annular chamber at one end and overlying an efflux point proximate to said outer cylindrical surface at the other, whereby liquid introduced to said annular chamber flows through said plurality of conduits to impinge on said outer cylindrical surface thereby being atomized by the vibratory motion thereon.

23. An ultrasonic generator as in claim 22 wherein said clamp has an additional annular chamber therein, together with an additional plurality of conduits in communication with said additional annular chamber at one end and overlying said outer cylindrical surface at a point adjacent to said efflux point at the other end, whereby an additional liquid introduced to said additional annular chamber transits said plurality of additional conduits to impinge on said outer cylindrical surface, thereby being atomized by the vibratory motion thereon and forming an emulsion with said atomized liquid.

24. An ultrasonic generator as in claim 19 wherein said tubular resonator section has the shape of a frustum of a cone.

* * * * *